US008506257B2

(12) United States Patent
Bottome et al.

(10) Patent No.: US 8,506,257 B2
(45) Date of Patent: Aug. 13, 2013

(54) ADJUSTABLE CAMBER AEROFOIL

(75) Inventors: Kristofer J. Bottome, Nottingham (GB); Matthew P. Jevons, Derby (GB)

(73) Assignee: Rolls-Royce PLC, London (GB)

( * ) Notice: Subject to any disclaimer, the term of this patent is extended or adjusted under 35 U.S.C. 154(b) by 531 days.

(21) Appl. No.: 12/795,069

(22) Filed: Jun. 7, 2010

(65) Prior Publication Data

US 2010/0329878 A1 Dec. 30, 2010

(30) Foreign Application Priority Data

Jun. 25, 2009 (GB) ..... 0910955.4

(51) Int. Cl.
*F01D 5/14* (2006.01)
*F01D 9/04* (2006.01)
*F04D 29/56* (2006.01)

(52) U.S. Cl.
USPC ..... 416/224; 416/132 A

(58) Field of Classification Search
USPC ..... 416/96 A; 244/35 R
See application file for complete search history.

(56) References Cited

U.S. PATENT DOCUMENTS

| | | | | |
|---|---|---|---|---|
| 1,846,146 | A | 2/1932 | Rocheville | |
| 1,918,897 | A | 7/1933 | Colburn | |
| 5,887,828 | A * | 3/1999 | Appa | 244/215 |
| 6,015,115 | A | 1/2000 | Dorsett et al. | |
| 6,260,795 | B1 * | 7/2001 | Gay et al. | 244/16 |
| 7,452,182 | B2 * | 11/2008 | Vance et al. | 415/135 |
| 8,016,249 | B2 * | 9/2011 | Sar et al. | 244/218 |
| 8,056,865 | B2 * | 11/2011 | Grip | 244/219 |
| 2002/0066831 | A1 | 6/2002 | Ngo et al. | |
| 2006/0214065 | A1 * | 9/2006 | Jaenker | 244/219 |
| 2006/0226290 | A1 * | 10/2006 | Campbell | 244/123.1 |
| 2009/0079301 | A1 | 3/2009 | Grohmann et al. | |

FOREIGN PATENT DOCUMENTS

| | | | |
|---|---|---|---|
| DE | 33 20 481 | A1 | 12/1984 |
| DE | 40 07 694 | A1 | 9/1991 |
| DE | 10 2005 061 751 | A1 | 7/2007 |
| DE | 10 2007 028 939 | A1 | 1/2009 |
| DE | 10 2008 012 281 | A1 | 9/2009 |
| FR | 2 277 723 | | 6/1976 |
| GB | 2 296 696 | A | 7/1996 |
| WO | WO 03/018853 | A2 | 3/2003 |
| WO | WO 2008/068472 | A1 | 6/2008 |

OTHER PUBLICATIONS

Sep. 7, 2012 European Search Report issued in Application No. EP 10 16 5054.
Oct. 20, 2009 Search Report issued in British Patent Application No. 0910955.4.

* cited by examiner

*Primary Examiner* — Nathaniel Wiehe
*Assistant Examiner* — Alonzo N Coleman
(74) *Attorney, Agent, or Firm* — Oliff & Berridge, PLC

(57) ABSTRACT

The present invention relates to an aerofoil (20) comprising a leading edge portion (22) and a flexible thin-walled portion (26) that is rearwards of the leading edge portion, defining a cavity (28), and a shape-forming insert (30) for inserting into the cavity. The shape-forming insert at least partly defines the profile of the aerofoil such that changing the shape of the insert changes the profile of the aerofoil.

14 Claims, 4 Drawing Sheets

ADJUSTABLE CAMBER AEROFOIL

BACKGROUND

The present invention relates to an aerofoil with an adjustable camber, and to a method of changing the camber of an aerofoil.

Many current large aero engines use a fixed Fan Outlet Guide Vane (OGV) system. The system is multifunctional in that it provides a structural support between the core and the fan case modules via the vanes themselves, which can withstand torque, fan-blade-off events and reverse thrust loads. In addition the fan OGVs have aerodynamic functions including separating the fan flow between the core and bypass duct.

FIG. 1 shows in cutaway view a part of an aero engine 10 in which air is directed rearwardly by a fan 12 and is separated into core flow 14 and bypass flow 16. A Fan Outlet Guide Vane (OGV) is shown at 18.

In order to maximise aerodynamic efficiency, whilst minimising cost, three different cambers, or profiles, of vanes are used in a cyclic pattern around the engine. These are defined as the datum camber, over-camber and under-camber.

FIG. 2 shows the different cambers of a previously considered OGV arrangement. An over-camber is represented at A, whilst B represents a datum, or normal, camber and C represents an under-camber.

As a further step to improve efficiency, the vanes each have a different cyclic stagger. This means that the angle of incidence to the fan flow is different for each vane. 3D flow modelling is used to obtain the optimum pattern.

Ideally more variation in vane camber would be utilised, but with previously considered approaches the cost would be prohibitive, as different tooling would be required to manufacture each of the differently cambered blades.

In some systems, including the one shown and described in US Patent Application No US 20050241291 variable stator vanes (VSV) are used. VSVs are a series of ganged vanes that pivot near the front of the vane. The aerodynamic profile of the vane is fixed but the effective angle of incidence can be changed. A similar arrangement can be found in US 2004240990A. Both systems use a mechanical linkage attached to an actuator in order to achieve a variation in the angle of incidence, with a fixed geometry of vane. With VSVs the form or profile of the camber is not changed. Only the angle of incidence varies.

In U.S. Pat. No. 5,433,404B an aerofoil is proposed which uses cams or jacks as actuators to change the profile of a flexible part of the surface of the aerofoil, in order to control drag and to improve shock strength.

U.S. Pat. No. 6,644,919 teaches a rotor blade that has a structural leading edge and an insert which has a flap that may be controlled by a piezo-electric actuator. The trailing edge of the structural part of the blade is flexible and may be hinged to permit the insert to be placed in position within the structural part. The actuator causes the flap to move up or down.

DE 10 2007 028 939 describes a compressor having vanes or blades formed of a piezo material which with induction of an electrical potential difference in the guide vanes and/or blades can change their geometric shape. By changing the geometric shape the aerodynamic flow around is changed so that the gas turbine engine can adapt to different operating conditions.

U.S. Pat. No. 6,465,902 teaches a controllable camber windmill blade which uses a piezoelectric actuator to adjust the camber of the blade depending on the wind conditions.

SUMMARY

With certain exceptions, most of the previously considered systems for large engines rely on a fixed aerodynamic profile which is optimised for only a single operating condition. As an improvement, three different standards of vane camber have been introduced, as described above, but this has come from a compromised solution as the ideal aero geometry would have a different camber for each vane at each operating point. However, the limitations of cost, engine weight and ease of manufacturing have thus far prevented the reaching of this ideal solution.

In the case of a large engine this might require as many as forty-four different vane standards which would lead to problems with cost, availability of spares, reparability and manufacture.

Even for small engines the use of multiple vane standards in order to achieve optimum efficiency is still attractive.

Prior systems utilising mechanical actuation all have disadvantages. In particular, whilst the systems can be reasonably responsive, the fact that they are linked compromises versatility. A linkage does not allow the different areas of the engine to have slightly different camber profiles, which is desired in order to cope with downstream effects at different flow rates.

If the profile of the vane is fixed and only the angle of incidence can be altered, the aerodynamic efficiency cannot be optimised. Whilst changing the angle of incidence has a noticeable effect on efficiency, a greater effect can be seen if the aerodynamic profile of the vane is changed.

The present invention aims to address at least some of the above-mentioned problems.

The invention is defined in the attached independent claims to which reference should now be made. Further, preferred features may be found in the sub claims appended thereto.

According to the invention, there is provided an aerofoil (20) comprising a leading edge portion and a flexible thin-walled portion, rearwards of the leading edge portion, defining a cavity, and a shape-forming insert for inserting into the cavity, wherein the flexible thin-walled portion has an opening through which the shape-forming insert is inserted to at least partly defines the profile of the aerofoil such that changing the shape of the insert changes the profile of the aerofoil.

In a preferred arrangement the cavity is arranged in use to receive at least one of a plurality of differently shaped inserts, causing the profile of the aerofoil to adopt one of a number of profiles.

The shape-forming insert may be actuatable such that its shape is controllably variable, so as to cause the aerofoil to adopt different profiles.

The actuatable shape-forming insert preferably comprises at least one piezoelectric actuator arranged in use to cause the insert to change shape.

More preferably the actuatable shape forming insert comprises a plurality of piezoelectric actuators.

The shape forming insert may have a truss structure.

The aerofoil may comprise a vane.

The invention also includes a method of defining the profile of an aerofoil, the aerofoil comprising a leading edge portion and flexible thin walled portion located reawardly of the leading edge, defining a cavity and having an opening, the method comprising inserting into the cavity through the opening a shape-forming insert. The shape forming insert may be removable such that it may be replaced by a different shape forming insert having a different profile. The different profile may be the camber of the shape forming insert.

The method preferably comprises selecting a shape-forming insert from a plurality of differently shaped inserts.

The method may comprise inserting into the cavity a shape-forming insert which is actuatable so as to adopt different shapes, and controlling actuation of the shape forming insert to define the profile of the aerofoil.

The method may include inserting the shape-forming insert spanwise into the cavity.

Alternatively or additionally the method may comprise inserting the shape forming insert from an opening at a trailing edge of the aerofoil.

BRIEF DESCRIPTION OF THE DRAWINGS

Preferred embodiments of the invention will now be described by way of example only with reference to the accompanying diagrammatic drawings in which.

DETAILED DESCRIPTION

In one embodiment the invention addresses the requirement to vary the aerodynamic profile of an aerofoil by using inexpensive shape-forming inserts that can be manufactured easily in a multitude of different profiles and which can be selectively inserted into the aerofoil body. A set of aerofoils of different profiles can then be manufactured without the cost associated of machining each aerofoil individually.

Figure 1:
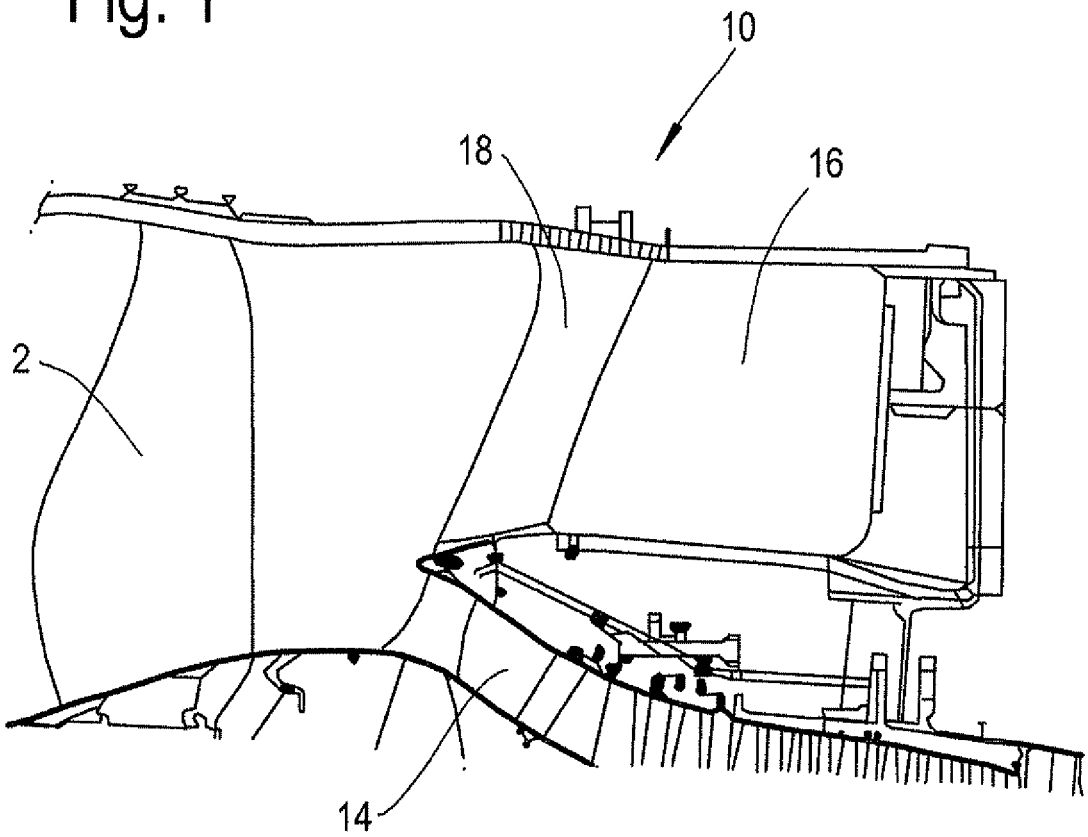
FIG. 1 shows in cutaway view a part of an aero engine having Outlet Guide Vanes (OGVs)
Figure 2:
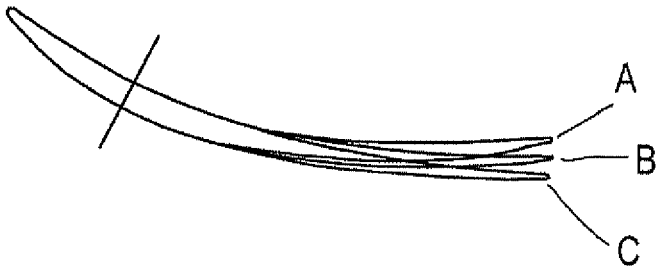
FIG. 2 shows in profile the camber variation of a previously considered design of fixed camber vane.
Figure 3:
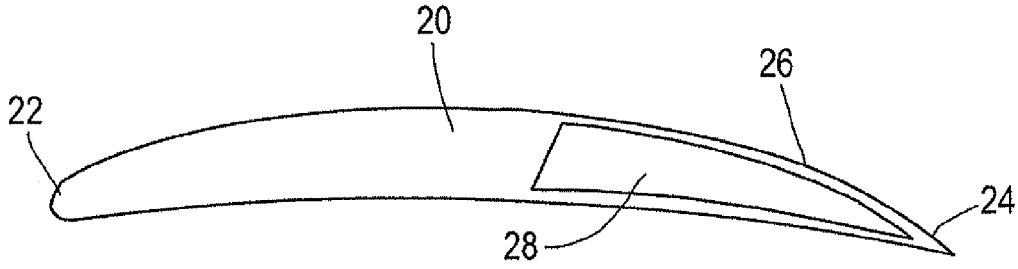
FIG. 3 shows schematically an aerofoil according to a first embodiment of the present invention.

Turning to FIG. 3, there is shown generally at 20 an aerofoil comprising an Outlet Guide Vane (OGV) having a leading edge 22 and a trailing edge 24. Towards the trailing edge 24 a thin, flexible-walled section 26 defines a cavity 28 for receiving a shape-forming insert (see FIG. 4).

Figure 4:
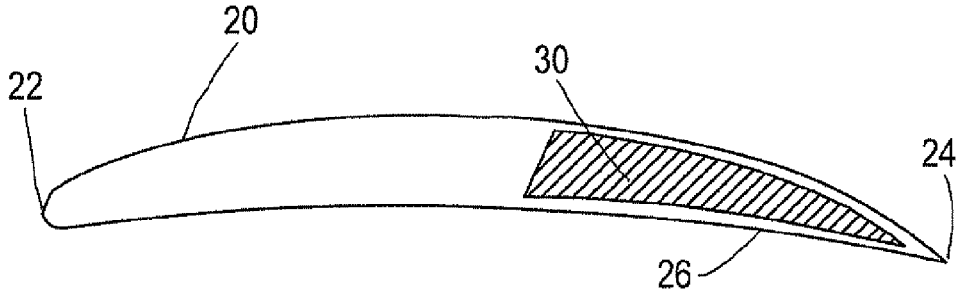
FIG. 4 shows schematically the aerofoil of FIG. 3 with a shape-forming insert.

FIG. 4 shows the OGV 20 with the shape-forming insert fitted inside the OGV in the cavity 28 formed by the flexible-walled section 26.

The leading edge and bulk of the aerofoil body provides the structural integrity of the aerofoil, but the trailing edge material is manufactured from a thin, flexible material. This can be the same material as the rest of the blade which might typically be of composite e.g. (fibre-reinforced resin) or metallic material, or can be an alternative material. For example, the thin flexible-walled section 26 could be manufactured of a thermoplastic PEEK or PPS material, or could be a metallic such as stainless steel or titanium alloy. The function of the thin flexible-walled section 26 is not to secure the insert in position but rather to present a flexible continuous surface to the airflow past the aerofoil, since any step or gap or other disturbance would effect the airflow on the surface of the aerofoil and would reduce efficiency.

Whereas the preferred embodiments of the present invention utilise composite materials for the vane, if the vane is instead of metal it is possible to make the vane as a first component and then attach the thin flexible-walled section 26 by welding or diffusion bonding. Machining the entire aerofoil in one process would be difficult but might be possible for some smaller vanes using spark erosion, also known as electro discharge machining (EDM), in which material is removed by a series of rapidly recurring electric arching discharges between an electrode (the cutting tool) and the workpiece, in the presence of an energetic electric field. The EDM cutting tool is guided along the desired path very close to the work but does not touch the actual workpiece. Consecutive sparks produce a series of micro-craters on the workpiece and remove material along the cutting path by melting and vaporization. The particles are washed away by a continuously flushing dielectric fluid.

For the preferred, composite blade, manufacture is more straightforward. An inflatable (or otherwise expandable) mould is provided around which the thin flexible-walled portion and the leading edge are laminated. Once the sheets have been laid down and cured the mould is deflated and removed. Silicone is preferred as the mould material.

The trailing edge section forms an open cavity which has flexible walls 26. An insert 30 (FIG. 4) shaped to provide the correct profile when fitted, is inserted in to the cavity. The insert 30 allows almost any profile of vane within the limits of the materials of the flexible walls. The insert 30 can be of honeycomb-type material, or could be a type of foam or could be a hollow former formed from a rolled sheet. The vane is assembled into the inner and outer rings of the vane system ready for use. The insert is manufactured simply and allows multiple variations in the vane camber to be produced from one set of tooling.

Figure 5:
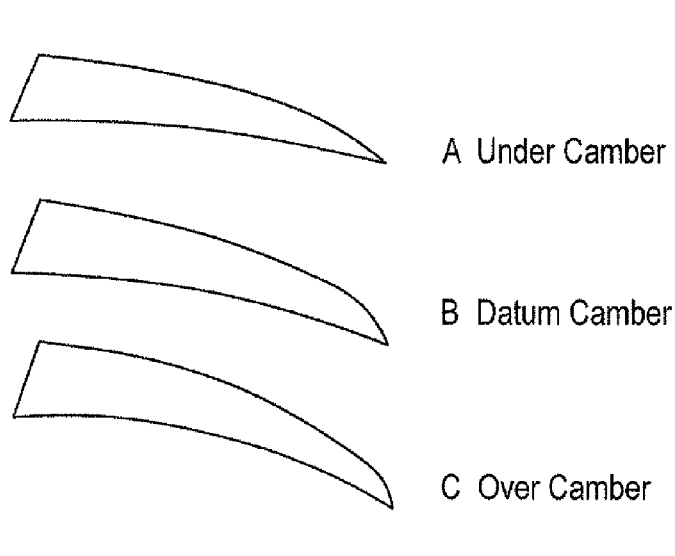
FIG. 5 shows schematically three different possible cambers for the aerofoil of FIGS. 3 and 4.

FIG. 5 shows three distinct cambers which are possible using the same OGV body with different inserts 30. An under-camber is represented at A whilst B represents the datum camber and C represents an over-camber profile.

The angles shown in FIG. 5 are not to scale. Typically there would be a maximum difference of around +/−4° from the datum camber to the over- and under-cambers respectively.

The insert 30 is placed into the aerofoil body 20 either spanwise or else it can be introduced in to the aerofoil from the trailing edge which must then subsequently be sealed, for example using a trailing-edge wrap of composite material.

The insert 30 can be bonded into position or held in place by its geometrical shape or else can be attached by rivets or other fixing devices.

Although the insert 30 requires a form of fixing to secure it into place on the structural part of the aerofoil, and it would therefore be possible to attach the insert first and then wrap the outside with a layer of flexible material, the use of the thin flexible-walled section 26 shown in the figures is preferred because this allows for simplification of the manufacturing process and therefore a reduction in part-unit costs. This approach also adds flexibility since an insert can be removed and replaced with another if desired, without replacing the structural part of the vane.

To manufacture the aerofoils an analysis of the desired blade shapes is made and these are compared to determine the location where the inserts should begin. Ideally, the location of the inserts is such that the first (i.e. leading) portion of the aerofoil should share a common form and can therefore be manufactured using a common design lay-up, tooling and process.

To further improve the number of aerofoil options available it is possible to provide a dynamically variable profile. The vane can be produced with a controllable, actuable datum camber insert which is capable of further bending shape with a flexible rear section with a hollow interior.

Figure 6:
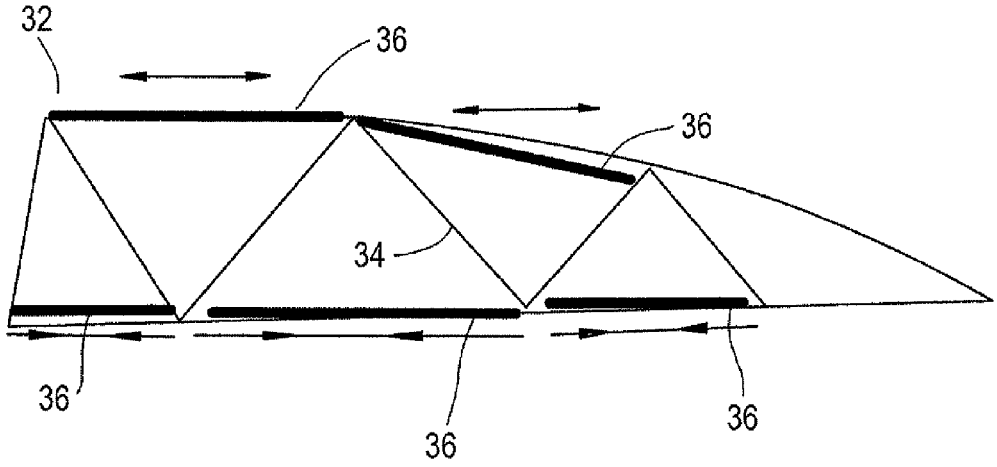
FIG. 6 shows schematically an aerofoil according to a second embodiment of the present invention.

FIG. 6 shows schematically a preferred embodiment of actuable insert generally at 32. The insert 32 has a Warren-truss structure and comprises a zig-zag of girders 34 with piezoelectric actuators 36. The piezo material is arranged such that its extension on one surface (either pressure or suction side) and contraction on the opposing surface causes the truss to bend.

Figure 7:
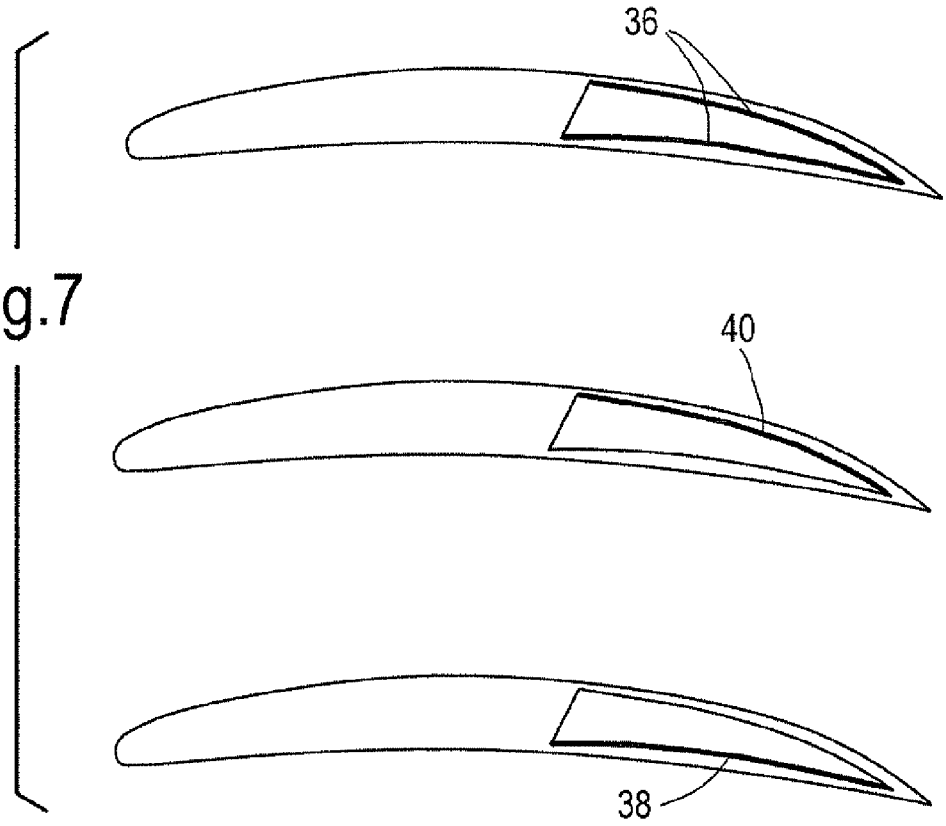
FIG. 7 shows three different possible cambers for the aerofoil of FIG. 6.

The piezo actuators are in a sheet form and lie broadly parallel. Alternatively they could be fitted in a criss-cross pattern. When a current is supplied the actuators expand and when the current is removed they contract. Using this property the profile of the vane can be changed. Referring to FIG. 7, for example, if an under-camber solution is required current is applied to an actuator 38 towards the pressure side of the vane. If over-camber is required current is applied to an actuator 40 towards the suction side of the vane.

Figure 8:
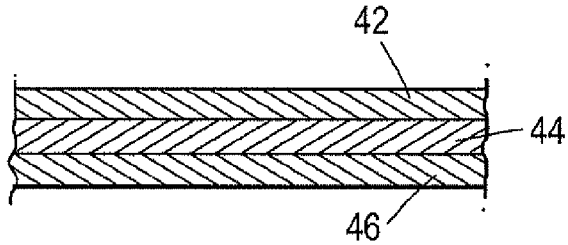
FIG. 8 shows schematically in section a part of a material lay-up for the aerofoil of FIGS. 6 and 7.

FIG. 8 shows a typical lay-up of the material of the wall of the insert 32. The material is arranged with a layer 42 which is capable of withstanding high strains on the outer surface. This could be titanium or another metal, or glass-epoxy system with unidirectional or woven type lay-ups. It could also be a PEEK type of material. Where the material is conductive it is necessary to provide an insulation material between the outer surface and the electrode used to actuate the piezo material 44 below. The piezo material may be any suitable material such as e.g. PZT or PVDF.

The inner supporting material 46 takes most of the structural loading and is a metallic material such as titanium or else could be carbon-epoxy material of PEEK type thermoplastics.

This system can be combined with feedback loops and sensors to monitor pressure loads and to adjust the vane dynamically to suit e.g. fan speed. This allows the camber to be changed for every aerodynamic operating point.

The adjustable camber solution according to the present invention provides a number of advantages. In particular, for a composite material there is no need for three separate moulds, i.e. the shape is controlled by an insert or by dynamic means. The piezo systems can control, stagger and camber dynamically which gives the vane significantly improved efficiency. Furthermore, all of the vanes can be locally and dynamically optimised for performance at all operating conditions. The systems as described above allow for a rigid leading edge/front portion of the blade which allows structural loads to be passed through the component as conventionally required. Leading edge protection can also be easily applied to the component.

The invention claimed is:

1. An aerofoil comprising:

a leading edge portion;

a flexible thin-walled portion that is rearwards of the leading edge portion, the flexible thin-walled portion defining a cavity; and a shape-forming insert for inserting into the cavity, wherein the flexible thin-walled portion has an opening through which the shape-forming insert is inserted to at least partly define a profile of the aerofoil such that changing a shape of the insert changes the profile of the aerofoil.

2. An aerofoil according to claim 1 wherein the cavity is arranged in use to receive at least one of a plurality of differently shaped inserts, causing the profile of the aerofoil to adopt one of a number of profiles.

3. An aerofoil according to claim 1 wherein the shape-forming insert is actuatable such that its shape is controllably variable, so as to cause the aerofoil to adopt different profiles.

4. An aerofoil according to claim 3 wherein the actuatable shape-forming insert comprises at least one piezoelectric actuator arranged in use to cause the insert to change shape.

5. An aerofoil according to claim 4 wherein the actuatable shape-forming insert comprises a plurality of piezoelectric actuators.

6. An aerofoil according to claim 3, wherein the shape-forming insert has a truss structure.

7. An aerofoil according to claim 1, which comprises a vane.

8. A method of defining a profile of an aerofoil, the aerofoil comprising a leading edge portion and a flexible thin-walled portion located rearwardly of the leading edge portion, the flexible thin-walled portion defining a cavity and having an opening, the method comprising:

inserting into the cavity through the opening a shape-forming insert.

9. A method according to claim 8 comprising selecting the shape-forming insert from a plurality of differently shaped inserts.

10. A method according to claim 8 comprising inserting into the cavity the shape-forming insert which is actuatable so as to adopt different shapes, and controlling actuation of the shape-forming insert to define the profile of the aerofoil.

11. A method according to claim 8, wherein the shape forming insert is a first shape forming insert and the method further comprises the step of removing the shape-forming insert from the cavity and inserting into the cavity through the opening a second shape-forming insert.

12. A method according to claim 11, wherein the second shape-forming insert has a different profile to the first shape-forming insert.

13. A method according to claim 12, wherein the profile is a camber.

14. A method according to claim 8, comprising inserting the shape-forming insert spanwise into the cavity.

* * * * *